US007445563B1

(12) United States Patent
Werner

(10) Patent No.: US 7,445,563 B1
(45) Date of Patent: Nov. 4, 2008

(54) VIBRATION DAMPING FOR HOLLOW GOLF CLUB HEADS

(75) Inventor: Frank Werner, Teton Village, WY (US)

(73) Assignee: Origin, Inc., Jackson, WY (US)

( * ) Notice: Subject to any disclaimer, the term of this patent is extended or adjusted under 35 U.S.C. 154(b) by 0 days.

(21) Appl. No.: 11/789,356

(22) Filed: Apr. 24, 2007

(51) Int. Cl.
*A63B 53/04* (2006.01)
*A63B 53/06* (2006.01)

(52) U.S. Cl. ..... 473/332; 473/333; 473/346

(58) Field of Classification Search ..... None
See application file for complete search history.

(56) References Cited

U.S. PATENT DOCUMENTS

| | | | | |
|---|---|---|---|---|
| 1,658,581 | A | 2/1928 | Tobia | |
| 4,067,572 | A | 1/1978 | Coleman | |
| 4,313,607 | A | 2/1982 | Thompson | |
| 4,432,549 | A | 2/1984 | Zebelean | |
| 4,438,931 | A | 3/1984 | Motomiya | |
| 4,535,990 | A | 8/1985 | Yamada | |
| 4,602,787 | A | 7/1986 | Sugioka et al. | |
| 4,681,321 | A | 7/1987 | Chen et al. | |
| 4,775,156 | A | 10/1988 | Thompson | |
| 4,811,949 | A | 3/1989 | Kobayashi | |
| 4,944,515 | A | 7/1990 | Shearer | |
| 5,000,454 | A | 3/1991 | Soda | |
| 5,064,197 | A | 11/1991 | Eddy | |
| 5,316,298 | A | 5/1994 | Hutin et al. | |
| 5,429,365 | A | 7/1995 | McKeighen | |
| 5,431,396 | A | 7/1995 | Shieh | |
| 5,464,211 | A | 11/1995 | Atkins | |
| 5,467,983 | A | 11/1995 | Chen | |
| 5,586,947 | A | 12/1996 | Hutin | 473/324 |
| 5,873,791 | A | 2/1999 | Allen | 473/309 |
| 5,890,973 | A | 4/1999 | Gamble | 473/326 |
| 5,941,782 | A | 8/1999 | Cook | 473/346 |
| 6,332,849 | B1 * | 12/2001 | Beasley | 473/332 |
| 6,524,197 | B2 * | 2/2003 | Boone | 473/324 |
| 2006/0135283 | A1 * | 6/2006 | Billings | 473/334 |

OTHER PUBLICATIONS

Business Page "ZEVO Mounts Comeback," Golf Week Dec. 15-22, 2001.

Figures 1-5 of Browning 300 Club. Published at least by Jan. 2001, photography of club model; admitted prior art.

* cited by examiner

*Primary Examiner*—Gene Kim
*Assistant Examiner*—Alvin A Hunter
(74) *Attorney, Agent, or Firm*—Westman, Champlin & Kelly, P.A.

(57) ABSTRACT

An internal vibration damper for hollow golf club heads is disclosed. Of particular concern is vibration of the club sole and crown when the face of the club impacts a golf ball. At least one column extends from the sole to the crown, approximately perpendicular to the surfaces of the sole and crown. The column construction or its mounting acts to dampen and reduce vibrations of the sole and crown toward and apart from each other upon ball impact on the face of the club head.

14 Claims, 3 Drawing Sheets

PRIOR ART FIG. 1
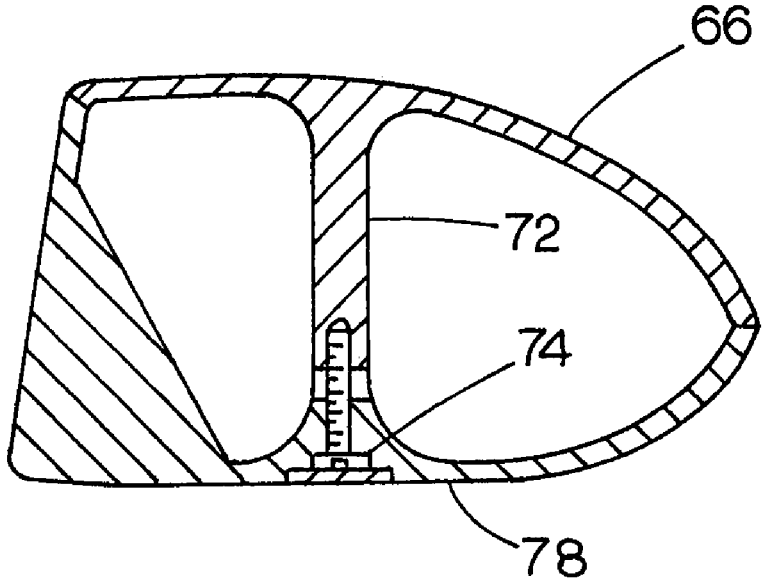
PRIOR ART FIG. 2
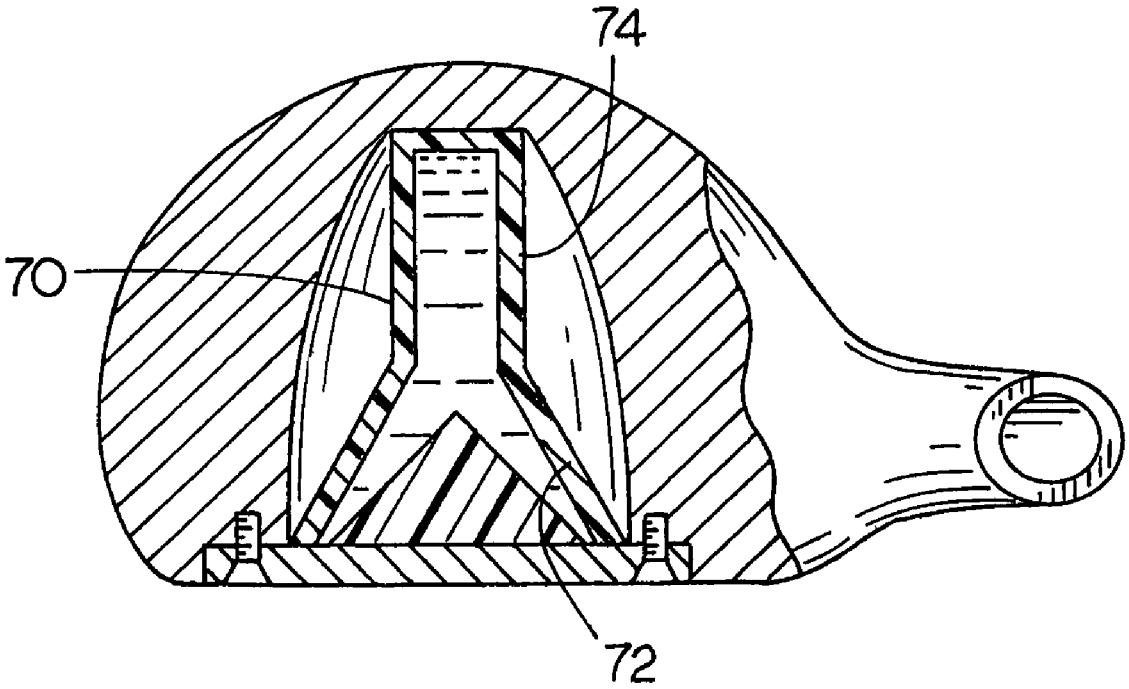

VIBRATION DAMPING FOR HOLLOW GOLF CLUB HEADS

BACKGROUND OF THE INVENTION

The present disclosure relates to damping sound and vibration in large hollow golf club heads by providing a damper between the sole and top wall or crown of such golf clubs.

Currently, large, hollow metal driver-type golf club heads typically generate a strong and often objectionable, sharp ringing sound immediately after impact of a face of the club head on a ball. When hollow metal heads first became available, they were often filled with a vibration-damping foam material. This added unwanted weight. What was worse, because of its lack of rigidity, the added weight of the foam did not participate fully in the impact. This caused reduced driving distance. More recently with even larger heads of this type, the ringing sound was allowed by club head designers, even with the objection of some golfers.

Test have shown that the impact of a ball on the club face of a typical modern hollow golf club head produces an amplitude of vibration of the crown (top wall) and sole (bottom wall) of the head such that the crown-sole distance expands about 0.02 inch during and immediately following impact. This causes a predominately crown-sole oscillation that persists for the order of one second and emits a sharp sound in the range of about 1000 to 5000 thousand cycles per second. This is in the general frequency range of maximum audible sensation to the ears of typical humans. The stiffness for a force tending to reduce the crown-sole distance was found to be about 2000 pounds of force per inch of deformation. Because peak forces on the club face at impact are in the range of 2500 pounds, the club head must be designed to have far greater stiffness for face-rear vibrations than the 2000 pounds per inch of crown-sole stiffness. For this reason, oscillations in the face-rear direction are far smaller, higher frequency, and emit much less audible sound.

Thus, reducing vibrations in the crown-sole direction is important for overall sound reduction. Vibrations in the face-rear direction are relatively unimportant. The damping structure should add fewer than about 2 grams of mass, because such mass may not significantly participate in the impact.

PRIOR ART

Vibration damping methods are widely known in the field of mechanical vibrations. When there is no damping, vibrations are not diminished and continue indefinitely. When viscous damping (damping force proportional to deformation velocity) is present, it may be small, with vibrations dying out slowly, or if larger, dying more rapidly. There is an amount of viscous damping called critical damping, which causes the vibrations to cease. More damping simply causes initial motion to cease more slowly but with no vibration. To reduce sound, damping is preferably in the range of about five times critical damping to one fifth of critical damping. The latter case allows vibrations but they diminish rapidly.

Viscous damping may be provided by liquids or semi-liquids that experience shear deformation. Many somewhat flexible solids may be deformed, but do not return quickly to their original shapes and approximate viscous damping in some respects.

As an alternate to the viscous damping discussed above, dry sliding friction may be used. That is the drag force when 2 flat surfaces of solids that are pressed together are caused to slide relatively to one another. This can effectively suppress continued vibrations when the drag force is suitable.

Finally, it is to be noted that all solids provide a degree of internal damping when stressed, ranging from extremely slight (hard steel for example) to quite large (some types of rubber for example). Thus in principle all structures stressed in tension, compression or shear have at least a slight degree of damping. In the present disclosure, damping materials include viscous liquids, those solids having large damping properties such as for some kinds of rubber, certain elastomeric plastics, and dry sliding friction.

U.S. Pat. No. 5,429,365 (McKeigen) shows a post member that joins a club head crown to its sole. This changes the fundamental (i.e. lowest) mode of vibration frequency to become much higher. That effect could eliminate sound only by raising the lowest vibration mode to a frequency above the audible range, which is unlikely. The purpose of the post is to join parts of the club head together. FIG. 1 of this disclosure was taken from that patent to illustrate the structure. Significant damping was not suggested.

U.S. Pat. No. 5,890,973 (Gamble) shows various face-rear members to influence behavior of the face upon impact. In one form shown in FIG. 2 of this disclosure, there is a structure 72 and 74 that may be filled with fluid. It is stated that this structure and at least some of its variations may provide damping and reduce the tinny sound of impact.

Those skilled in the field of vibrations will recognize that the configurations illustrated in the '973 patent may provide a degree of damping of face-rear vibrations, but are much less effective for reducing vibrations in the crown-sole direction than the configurations defined in this invention. The basic reason is that the present invention provides vibration damping effects directly on the important parts that cause most of the sound generation, namely the crown and sole.

U.S. Pat. Nos. 5,316,298 (Hutin et al.) and 5,586,947 (Hutin) show means for damping vibrations in golf club heads in which a visco-elastic layer is applied to the vibrating surface with an outer layer of more rigid material. While damping is obtained in this manner, the layered wall structure is very distinct from the present disclosure.

SUMMARY

The present disclosure provides damping coupling structure between the crown or top wall of a hollow metal golf club head and the sole or bottom wall.

The vibrations of a club head mostly make sound when the larger surfaces vibrate, principally when there is motion in the crown-sole mode (the crown bulging upward while the sole bulges downward and the reverse). This generates sound due to the broad surface areas of the crown wall and sole, because this is normally the lowest-frequency mode of vibration of a club head, and is excited by the transient forces of impact of the ball on the club head face. Small areas generate less sound than large areas.

In various embodiments shown, physical damping connections are provided between the crown and sole, which have the large surfaces of the hollow golf club head that are the source of most vibration and noise.

Damping structures disclosed include viscous liquids, solids having large damping properties, such as some kinds of rubber; certain elastomeric plastics and dry sliding friction.

Structural elements having such damping properties provide damping directly between the walls that cause the most sound generation, namely the crown and the sole.

BRIEF DESCRIPTION OF THE DRAWINGS

FIG. 1 is a drawing of a prior art club head taken from U.S. Pat. No. 5,429,365 showing a rigid, substantially non-damping crown-sole structural member for head strength.

FIG. 2 is a drawing of a prior art club head taken from U.S. Pat. No. 5,890,973 showing a face-rear internal member that is said to be capable of providing damping of vibration of the face and rear walls of a club head.

DESCRIPTION OF PREFERRED EMBODIMENTS

Figure 3:
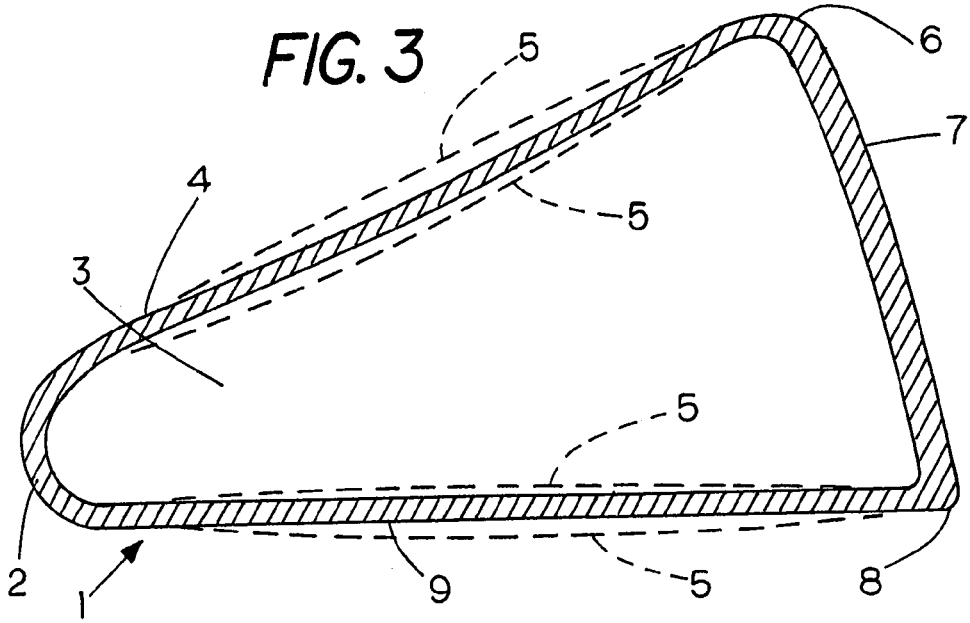
FIG. 3 is a hollow club head illustrating the nature of the vibrations of the crown and sole, which cause sound.

FIG. 3 is a drawing of a typical large hollow metal golf club head 1 having a face 7 held at edges 6 and 8 to a crown wall 4 and a sole wall 9, respectively. The face is conventionally welded in place. The club head is thus enclosed around the perimeter of the face, as is well known, leaving a hollow interior. The rear 2 of the club head joins the sole 9 and crown 4 and is spaced from the face.

The dotted lines 5 illustrate the basic mode of crown-sole vibration of the hollow driver head 1, immediately after impact by a ball on the face 7. These vibrations and deflections of the crown and sole cause a sound that can be heard by a golfer. Relatively slight face-rear movement (not shown) accompanies this vibration.

Figure 4:
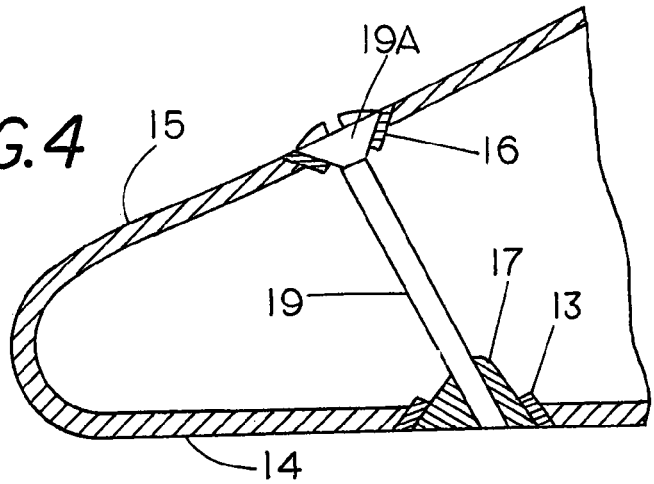
FIG. 4 shows one form of the damping structure of the present disclosure.

FIG. 4 fragmentarily shows a rear portion of a hollow golf club head having a sole wall 14 and crown wall 15, with a damping structure between the two walls. The damping structure comprises a screw 19 or other column that has rubber or elastomeric washers 16 and 13 under a conical head 19A of the screw and anchor nut 17, respectively. The screw or column 19 is thus connected to the crown and sole through damping structure. When the screw 19 is in tension, the rubber material of the washers 16 and 13 tends to flow outward from its rest position and thus provides damping effect. Rather than rubber, other moderately soft material may be used provided it has much internal damping and can return to shape after being loaded. The rubber washers 16 and 13 need not be at both ends of the screw or column 19 since only one washer, under the head 19A or nut 17 provides damping for the crown and sole.

Figure 5:
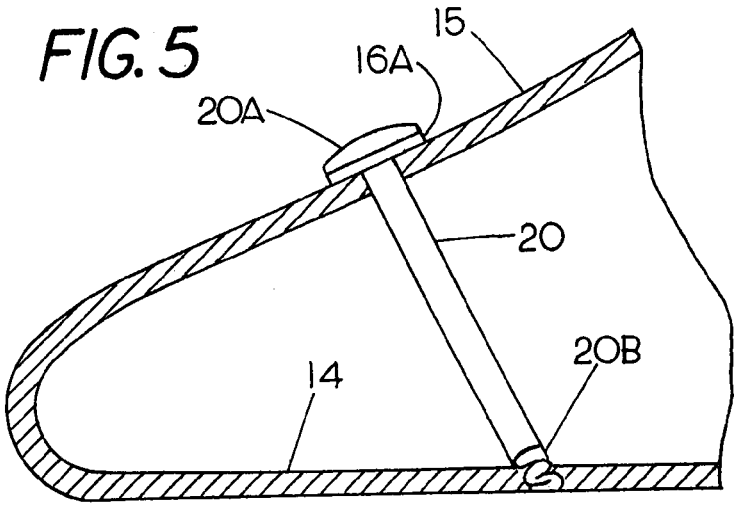
FIG. 5 shows another form of damping structure of this disclosure.

FIG. 5 shows a structure similar to FIG. 4, but using a flat-headed screw 20 with damping material 16A under its head 20A. The screw 20 is threaded at 20B into a threaded bore in the sole 14. The washer 16A dampens vibration of the crown wall 15 and sole 14.

Figure 6:
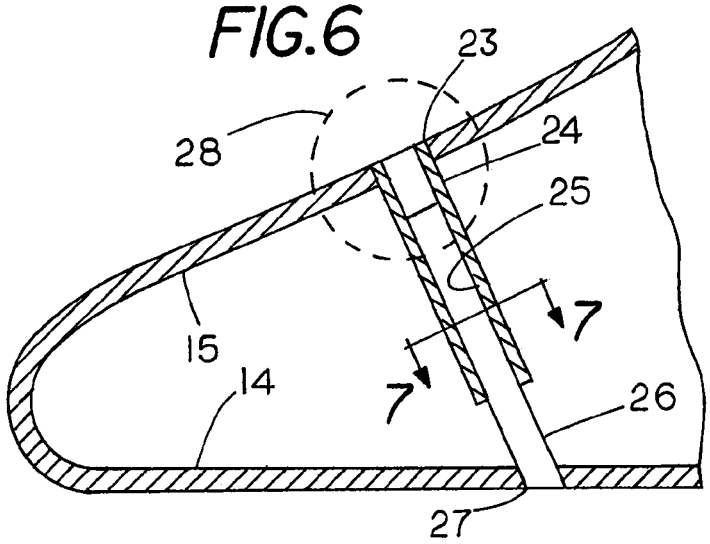
FIG. 6 shows a form of damping structure of the present disclosure that may use deformation of a solid or liquid or may use dry sliding damping.

FIG. 6 shows a damping structure between crown wall 15 and sole wall 14 comprising a tube 24 and an internal telescoping rod 26 that slides in the bore of the tube 24. The friction of relative sliding of the rod and tube provides damping. A lining of material 25 slides on either the inner surface of the tube 24 or rod 26 to provide controlled friction. More details of this construction are provided in FIGS. 7, 8, and 9.

Figure 7:
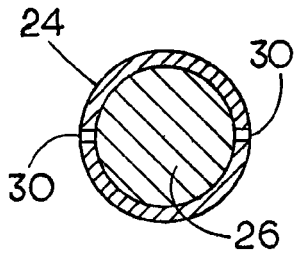
FIG. 7 is a cross sectional view taken as on line 7-7 in FIG. 6.

FIG. 7 shows how the outer tube 24 of FIG. 6 may be modified by having slits 30 in one or both sides. It may have an inside diameter slightly smaller than internal rod 26, with the result that dry sliding friction is provided when the crown 15 and sole 14 move relative to each other as they vibrate, thus providing the damping of the vibrations.

Figure 8:
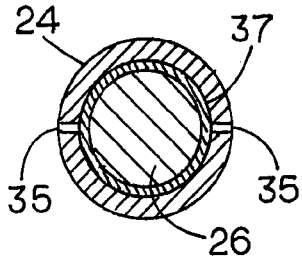
FIG. 8 is a cross sectional view similar to FIG. 7 but illustrates how a controlled dry friction lining layer may be used for less wear than the FIG. 7 showing.

FIG. 8 shows how a lining material 37 may be interposed between tube 24 and rod 26 of FIG. 6 wherein the material can be selected to provide controlled sliding friction, with little wear. A material such as automobile brake lining material may be used.

Figure 9:
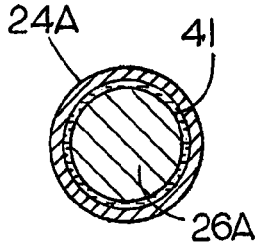
FIG. 9 is a cross sectional view similar to FIG. 7, but including a thick, viscous liquid or semi soft material between telescoping tubular cylinders to provide damping.

FIG. 9 is similar to FIG. 8 but without slits in the tube 24A and there is a viscous liquid filling 41 in the space between the inner surface of the tube 24A and the rod 26A, without need of clamping action. The viscous liquid is best chosen from highly viscous liquids. To avoid the liquid from moving out from the tube 24A, the liquids may be replaced by semi-liquids that behave as solids but begin to flow when only slight stress is applied, such as heavy grease. Another possibility is use of rubber or other semi-solid damping material.

Either the tube 24 or rod 26 may extend from crown to sole and may be attached to the sole or crown 15 by anchoring by bonding or otherwise on the inner surface of the crown wall or sole wall or in a hole in the wall as in FIG. 6. The tube or rod may be of vibration absorbing material having Young's modulus stiffness in the range of 50,000 up to 5,000,000 pounds per square inch, density less than 1.5 grams per cubic centimeter, and good internal damping characteristics. Some polyurethane formulations are suitable.

Figure 10:
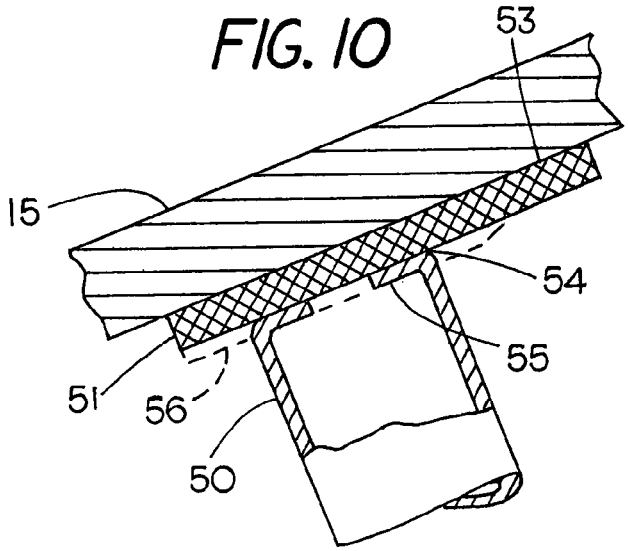
FIG. 10 is a fragmentary sectional view showing a crown-sole tubular damping structure attached to the crown of a golf club, with a rubber attachment layer used to provide damping.

FIG. 10 is an enlarged view of a modified junction in the region between a tube such as tube 24 and the crown shown at dotted circle 28 FIG. 6. The modified junction shows a tubular member 50, preferably with ends somewhat deformed inward as shown at 55 to provide end surface area and with a patch or layer of rubber-like (elastomeric) damping material 51 that is firmly bonded to the end of the tubular member 50. While the crown 15 of a club is illustrated, a similar structure may be at the sole end of tube 50 instead. Alternately both ends of tubular member 50 can be similarity attached to both the sole and crown by the damping material 51.

A small amount of bonding material shown at 53 may be used at the periphery or edge of material layer 51, to secure the material 51 to the inner surfaces of the crown (or sole). The other portions of the damping material 51 may separate momentarily from the inner surface of crown 15 during a vibration, as indicated at dotted line 56, but the bonding attachment at 53 keeps the tubular member 50 and material 51 in place. The layer or patch 51 is selected in size to provide some movement in the center during vibration, but yet hold the tube 50 in place. As shown, the patch 51 may be round or square and with a diameter or side length in face to rear wall direction about 2 times the diameter of tube 50.

The bond for the patch of material 51 is applied only in selected locations, as shown only at 53, so that if the crown moves away from the vibration damper tube, the patch of material 51 can flex as indicated by dotted lines 56, without breaking the bond. While only one bond location 53 is shown, there may be more than one and if the patch of damping material 51 has adequate diameter or size, and low enough stiffness, the bonding to the crown (or sole) could be in the form of a peripheral bond along the outer edge of the patch of material 51.

The lowest resonant frequency of the internal crown-sole column or member disclosed for vibrations in the face-rear direction, which is the direction transverse to the long axis of the column or member, and which is called the transverse mode of vibration, should be above 2000 Hz. Preferably the lowest resonant frequency in the transverse mode is well above 2000 Hz, for example 4000 Hz or more, so that ball-face impact does not cause excessive vibration of the internal crown-sole column or member in the face-rear direction relative to the club head.

The cross sectional shape of tubes or columns shown does not have to be circular, but may be of other shapes. A rectangular shape or I-beam shape could be used so that the stiffness in the face-rear direction is high enough to minimize face-rear deformation of member 50 during the short time of ball-face impact.

Figure 11:
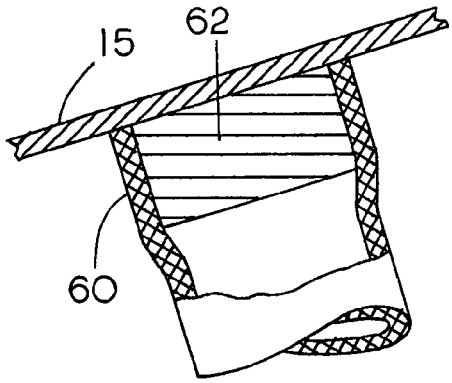
FIG. 11 is a fragmentary cross sectional view showing an attachment structure for attaching a tube of damping material to a wall of the golf club head.

In the embodiment shown in FIG. 11, a vibration absorbing or damping tube 60 is of size to be fitted onto a plug or short post 62 that is fixed to the crown 15. If the fit is free, so the tube 60 can slide on the plug or post 62, the vibration damping occurs when the tube 60 is compressed against the inner surface of crown 15. The tube is cut to length so it abuts the inner surface of crown 15 at rest. If the tube fits with some friction between the plug and the tube, but is still movable, slippage of the tube 60 on the plug of post 62 add damping when the parts slip. If the tube is force fitted on the plug 62, so the fit is very tight, the tube 60 will provide damping in both tension and compression as the crown 15 vibrates as shown in FIG. 3. The plug or post 62 can be used for mounting the tube 60 to the club head sole, if desired. All of the listed variations of fit between the tube 60 and plug 62 are usable.

A calculated example, for a tube 60 of durometer about 55 A polyurethane with Young's modulus of 100,000 pounds per square inch, density of 1.2 grams/cubic centimeter, outside diameter of ⅜ inch, inside diameter of 5/16 inch and length of 1.5 inches, indicates the tube has a lowest resonant frequency of 2500 to 5000 Hz. The resonant frequency depends in part on how firmly the ends of the tube 60 are attached to the sole and crown. This range of lowest resonant frequencies would be satisfactory, but a lowest resonant frequency higher than this range is desirable. If the lowest resonant frequency in bending is much below this range, tube 60 is subject to excessive transverse vibrations at ball impact in the face-rear direction that would cause its mass to not fully participate in the impact, resulting in slightly less distance of a golf shot, and the damping capability of the tube 60 may be diminished. The above example of ⅜ inch outside diameter tubing weighs about 1.0. gram. The tubular configuration is thus preferable to a solid cylinder. The tube need not have a round cross section.

It is noted that use of 2 or more of the various damping structures described above may be positioned approximately as desired for best damping.

The embodiment of FIG. 10 is easily constructed. The reason is that for many cases, the face structure is welded to the rear shell, and use of the FIG. 10 design allows the damping device to be positioned and bonded as required inside the shell between the crown and sole before the face is in place. The face is welded on to the hollow head after this mounting step. The use of a rod or tube of suitable damping characteristics such as polyurethane may also be desirable, as described above. Other of the forms described may be preferred to facilitate other methods of manufacture of the hollow club head.

In any case, suitable damping can be satisfactorily estimated by analytical methods, but experiments are generally necessary to make sure that suitable damping and durability are achieved. Fortunately, the level of damping may vary substantially with acceptable results.

Although the present invention has been described with reference to preferred embodiments, workers skilled in the art will recognize that changes may be made in form and detail without departing from the spirit and scope of the invention.

What is claimed is:

1. A hollow golf club head having a crown wall and a sole wall defining a hollow chamber, and at least one lightweight internal member joined between the crown wall and sole wall, the internal member having vibration damping means acting between the crown wall and sole wall for damping relative motions between said crown wall and sole wall, the internal member including two sections, each section being connected to one of the crown or sole walls, and wherein the vibration damping means is selected from a group consisting of viscous damping material between the two sections of the internal member and sliding friction between the two sections of the internal member.

2. The golf club head of claim 1 wherein the internal member comprises a telescoping column having two parts slidable relative to each other, a layer of controlled friction material between surfaces of the two parts, and the damping means comprises friction between the controlled friction material layer and the two parts of the column.

3. A hollow golf club head having a crown wall and a sole wall defining a hollow chamber, and at least one lightweight internal member joined between the crown wall and sole wall, the internal member comprising a telescoping column having two portions slidable relative to each other, and means for damping comprising friction between the two portions of the column for damping relative motions between said crown wall and said sole wall.

4. A hollow golf club head having a crown wall and a sole wall defining a hollow chamber, at least one lightweight internal member for damping relative motions between said crown wall and sole wall comprising a column extending between the crown wall and the sole wall, said column being mounted to both the crown wall and the sole wall, and a separate vibration damping material comprising at least part of the mounting between at least one of the crown or sole walls and the column.

5. The golf club head of claim 4 wherein said damping material comprises an elastomeric material positioned between the column and at least one of the crown or sole walls.

6. The golf club head of claim 4 wherein said damping material comprises a patch of elastomeric material having a portion secured to an end of the column, and the elastomeric material patch having edge portions that are bonded to the at least one of the crown and sole walls at selected locations other than the portion secured to the end of the column.

7. A hollow golf club head having a crown wall, a sole wall, and a rear wall, said crown wall and sole wall being spaced from each other to define a hollow chamber, a club face secured around a periphery to the crown wall and sole wall to enclose the hollow chamber at an end thereof opposite from the rear wall, at least one internal column extending between the crown wall and sole wall, and mounted to the crown wall at a first end thereof and the sole wall at a second end thereof, said internal column providing vibration damping for movements between the crown wall and sole wall by one of the structures consisting of vibration damping material having damping in the range of one fifth to five times critical damping between the column and at least one of the crown and sole walls, providing a two part column that has two parts slidably mounted relative to each other and when relatively sliding are under dry sliding friction, and providing a two part column with said two parts of the column being movable relative to each other and having a gap between the two parts that is filled with viscous damping material.

8. The golf club head of claim 7 wherein the internal column has a head at on least one end, and the selected one vibration damping structure comprises a vibration damping material in the form of a washer beneath the head and against an exterior surface of one of the crown or sole walls.

9. The golf club head of claim 7 wherein the internal column is constructed to have a resonant frequency in its lowest resonant frequency in a transverse mode of vibration of at least 2000 Hz when joined to the sole wall and crown wall.

10. The golf club head of claim 7 wherein the column comprises a tube made of the vibration damping material, at least one end of the column having a plug secured to one of the crown or sole walls and fitting inside one end of the tube, for mounting the one end to at least one of the crown or sole walls.

11. A hollow golf club head having a crown wall, a sole wall, a rear wall and a face forming a hollow chamber with the crown wall and sole wall spaced apart, the face enclosing the hollow chamber at an end thereof opposite from the rear wall, at least one internal column extending between the crown wall and sole wall, the internal column being mounted to the crown wall at a first end thereof and the sole wall at a second end thereof, a mounting structure between at least one end of the column and at least one of the crown or sole walls comprising a patch of elastomeric material having center portions secured to the one end of the internal column, and the patch having edge portions that are bonded to at least one of the crown or sole walls only at selected locations of the edge portions, the patch of elastomeric material having a dimension in a direction between the face and rear wall of substantially twice a cross-sectional length of the internal column in the direction between the face and rear wall.

12. The golf club head of claim 11 wherein center portions of the patch of elastomeric material are unsecured relative to the at least one of the crown or sole walls.

13. The golf club head of claim 11 wherein the internal column is constructed to have a lowest resonant frequency of vibration in a transverse mode of vibration of at least 2000 Hz when joined to the sole wall and crown wall.

14. The golf club head of claim 11 wherein the internal column comprises a hollow tube, and wall portions are formed at least at one end across the tube to provide a surface contacting the patch of material for securing the internal column to the patch of elastomeric material.

* * * * *